US010724794B2

(12) United States Patent
Niklaus et al.

(10) Patent No.: US 10,724,794 B2
(45) Date of Patent: Jul. 28, 2020

(54) TREATMENT DEVICE AND TREATMENT METHOD

(71) Applicant: AUTEFA SOLUTIONS GERMANY GMBH, Friedberg (DE)

(72) Inventors: Michael Niklaus, Seuzach (CH); Kuzma Plugachev, Trägerschen (CH)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 87 days.

(21) Appl. No.: 15/774,776

(22) PCT Filed: Nov. 10, 2016

(86) PCT No.: PCT/EP2016/077296
§ 371 (c)(1),
(2) Date: May 9, 2018

(87) PCT Pub. No.: WO2017/081172
PCT Pub. Date: May 18, 2017

(65) Prior Publication Data

US 2018/0328662 A1 Nov. 15, 2018

(30) Foreign Application Priority Data

Nov. 10, 2015 (DE) ..... 20 2015 106 039 U

(51) Int. Cl.
*F26B 3/06* (2006.01)
*F26B 21/00* (2006.01)
(Continued)

(52) U.S. Cl.
CPC ..... *F26B 3/06* (2013.01); *F26B 13/06* (2013.01); *F26B 13/08* (2013.01); *F26B 21/004* (2013.01);
(Continued)

(58) Field of Classification Search
CPC ..... F26B 3/06; F26B 13/08; F26B 21/004; F26B 21/02; F26B 25/06; D04H 5/03
(Continued)

(56) References Cited

U.S. PATENT DOCUMENTS 1,878,279 A * 9/1932 Langsner ..... G03B 27/303 34/659
2,772,486 A 12/1956 Johanson
(Continued)

FOREIGN PATENT DOCUMENTS

CN 1037581 A 11/1989
CN 101476817 A 7/2009
(Continued)

*Primary Examiner* — Stephen M Gravini
(74) *Attorney, Agent, or Firm* — McGlew and Tuttle, P.C.

(57) ABSTRACT

A treatment device (1) and a treatment method for a web (2) of endless material, in particular of a textile fiber material, preferably a non-woven fabric are provided. The treatment device (1) includes a treatment chamber (14) in which the moving web (2) is treated with a flowing gas, in particular air, an inlet (10) and an outlet (11) for the web (2), and a plurality of chamber regions (20-24). The plurality of chamber regions (20-24) are stationarily arranged on top and next to each other. The web (2) runs through the plurality of chamber regions (20-24). In the chamber regions (20-24), the gas, in particular the air, flows against and through the web (2) from one side.

22 Claims, 8 Drawing Sheets

(51) Int. Cl.

| | |
|---|---|
| ***F26B 21/02*** | (2006.01) |
| ***F26B 13/06*** | (2006.01) |
| ***F26B 13/08*** | (2006.01) |
| ***F26B 25/06*** | (2006.01) |
| ***D04H 5/03*** | (2012.01) |

(52) U.S. Cl.
CPC ..... *F26B 21/02* (2013.01); *F26B 25/06* (2013.01); *D04H 5/03* (2013.01)

(58) Field of Classification Search
USPC ..... 34/465
See application file for complete search history.

(56) References Cited

U.S. PATENT DOCUMENTS

| | | | | |
|---|---|---|---|---|
| 4,245,397 | A | 1/1981 | Laar et al. | |
| 4,270,283 | A | 6/1981 | Ellis | |
| 4,872,270 | A * | 10/1989 | Fronheiser | F26B 3/00 34/421 |
| 4,952,145 | A | 8/1990 | Kwiatkowski et al. | |
| 5,287,637 | A * | 2/1994 | Dixit | B29B 13/06 226/173 |
| 5,564,200 | A * | 10/1996 | Strahm | D06C 3/02 34/635 |
| 5,749,164 | A * | 5/1998 | Bowden | F26B 13/104 34/641 |
| 5,881,476 | A * | 3/1999 | Strobush | F26B 13/10 34/210 |
| 7,809,253 | B2 * | 10/2010 | Mudry | F26B 13/10 34/226 |
| 8,109,010 | B2 * | 2/2012 | Hamamoto | B05D 3/0254 118/58 |
| 8,984,763 | B2 * | 3/2015 | Savarese | F26B 3/28 34/266 |
| 9,316,442 | B2 * | 4/2016 | Hong | D06F 58/00 |
| 9,939,198 | B2 * | 4/2018 | Hoffman, Jr. | F26B 15/12 |
| 10,113,795 | B2 * | 10/2018 | Hoffman, Jr. | F26B 3/04 |
| 10,281,211 | B2 * | 5/2019 | Savarese | F26B 3/28 |
| 2005/0160621 | A1 * | 7/2005 | Hartmann | F26B 13/10 34/629 |
| 2006/0124772 | A1 | 6/2006 | Pourdeyhimi et al. | |
| 2017/0227286 | A1 * | 8/2017 | Schmit | D21F 5/18 |
| 2018/0266763 | A1 * | 9/2018 | Yoshinuma | F26B 3/20 |
| 2018/0328662 | A1 * | 11/2018 | Niklaus | F26B 3/06 |
| 2019/0270088 | A1 * | 9/2019 | Tanaka | B02C 23/14 |
| 2019/0316839 | A1 * | 10/2019 | Niklaus | F26B 21/08 |

FOREIGN PATENT DOCUMENTS

| | | | | |
|---|---|---|---|---|
| CN | 101818413 | A | 9/2010 | |
| CN | 103668840 | A | 3/2014 | |
| DE | 20 2014 103 343 | U1 | 10/2015 | |
| DE | 202015106039 | U1 * | 2/2017 | F26B 3/06 |
| EP | 0 372 444 | A1 | 6/1990 | |
| EP | 2 181 298 | A2 | 5/2010 | |
| EP | 2 694 727 | B1 | 5/2016 | |
| GB | 191101303 | A | 11/1911 | |
| SU | 1 615 504 | A1 | 12/1990 | |
| SU | 1 036 128 | A1 | 2/1991 | |
| WO | 96/22419 | A1 | 7/1996 | |
| WO | 2007100171 | A1 | 9/2007 | |
| WO | 2009/012943 | A2 | 1/2009 | |
| WO | WO-2017081172 | A1 * | 5/2017 | F26B 21/02 |

* cited by examiner

TREATMENT DEVICE AND TREATMENT METHOD

CROSS REFERENCE TO RELATED APPLICATIONS

This application is a United States National Phase Application of International Application PCT/EP2016/077296, filed Nov. 10, 2016, and claims the benefit of priority under 35 U.S.C. § 119 of German Application 20 2015 106 039.4, filed Nov. 10, 2015, the entire contents of which are incorporated herein by reference.

FIELD OF THE INVENTION

The present invention pertains to a fluidic treatment device, especially a drying device, and to a treatment method with the features described in the preamble of the principal method claim and of the principal device claim.

BACKGROUND OF THE INVENTION

Tunnel driers for textile material webs, in the treatment chamber of which the material web moving linearly from an inlet to an outlet, is dried with a gas flow, are known from practice. Further, drum driers are known, in which the material web is placed onto a rotating and heated drum.

SUMMARY OF THE INVENTION

The object of the present invention is to provide an improved treatment technique.

The present invention accomplishes this object with a fluidic treatment technique, i.e., the treatment device and the treatment method, that have various advantages. This especially applies to the improved configuration as a drying device and a drying method.

The treatment device may have a very compact structure and operate efficiently due to the division of the treatment chambers into a plurality of chamber areas, which are arranged above one another and next to one another as well as preferably in a stationary manner and through which the material web passes. A gas, especially air, may flow against and through the material web on one side in each of the chamber areas. The chamber areas are each separated from one another and the material web traverses or passes through them. Within the treatment chamber, the material web is guided along its path of motion by means of a guiding device, preferably by means of a belt-like and gas-permeable conveying device. The gas flow can be held in permanent contact with the material web and fix it to the conveying device.

The treatment device may especially have a cube-shaped and propped-up housing. The space required is smaller than in case of elongated tunnel driers. Moreover, the efficiency of the fluidic treatment, especially drying of the material web with a gas flow, preferably with an air flow, can be increased. It is advantageous, moreover, that the functional areas of the treatment device are readily accessible from the outside for purposes of maintenance and inspection, etc.

An independent inventive idea provides that the running material web is guided in a path of motion directed upwards and downwards in the treatment chamber. The path of motion is preferably configured as an upright loop, one or more of which may be present. This is advantageous for an efficient flow of the material web with the gas provided for the treatment, especially drying. In particular, there are flow-related, energy-related and treatment-related advantages in connection with an arrangement of a plurality of chamber areas above one another and next to one another. An arrangement of the chamber areas in a chamber matrix with a plurality of, preferably two, columns next to one another and with a plurality of rows above one another is especially advantageous. A central, connecting chamber area may be arranged on the top side of this chamber matrix.

This arrangement of chamber areas is especially advantageous for generating a circulating flow by the material web in the respective chamber area. In addition, a chamber-overlapping counterflow of the treatment gas can be achieved, which is directed against the run direction of the material web. This makes possible an adaptation of the gas climate control. In particular, the moisture content in the counterflow may increase from the outlet to the inlet. During a drying process, the moisture content of the material web and of the gas flow can thereby be optimally adapted to one another.

The chamber areas are separated from one another, e.g., by partitions. The material web traverses each of the partitions approximately in the center. Due to the circulating flow separated in the form of chambers, the flow-related and climatic conditions in the respective chamber area may also be optimally adapted to the state of the material web there. This may pertain to, e.g., the flow rate and/or the temperature and/or the moisture content of the gas flow.

In another independent inventive idea provisions are made for the inlet and the outlet of the material web to be arranged at the lower area of the treatment device. They are preferably located at the bottom of the treatment chamber. The material web may enter and exit here in upright, especially vertical extension. This arrangement has energy-related advantages. Heat losses and an escape of hot gas from the inlet and the outlet can be reduced. This pertains especially to the discharge of hot gas from the outlet with the moved material web. A natural gas lock, especially air lock, results due to the natural thermal parameters of the treatment gas located and preferably heated in the treatment chamber.

In addition, the chamber areas located at the inlet and the outlet and preferably arranged near or at the bottom are regulated at a lower temperature than the other chamber areas adjoining upwards in the chamber matrix. Another advantage of the chamber matrix and of the arrangement of a plurality of chamber areas above one another separated from one another is a clean separation of the hot and cooler gas flows, especially circulating flows. The treatment process, especially drying process, can be better and more accurately controlled and possibly be regulated when a corresponding sensor mechanism is used. In addition, energy can be saved due to the lowered temperature in the lower chamber areas. In addition, the material web can already cool off in the area of the outlet and exit with a lower temperature from the treatment device. As a result, less energy is discharged with the material web into the surrounding area.

The chamber areas are separated from one another by partitions. Some of the partitions may have a gas-tight configuration and some may have a gas-permeable configuration. In particular, an upright and essentially gas-tight partition may be arranged in the center and between the columns of the chamber matrix. The preferably horizontally circulating flows in the chamber areas arranged next to one another may be separated from one another as a result. Gas-permeable partitions may be arranged in a horizontal position between the rows of chambers areas, which lie above one another, in the chamber matrix. This makes possible a passage of gas for said counterflow against the run direction and along the path of motion of the material web.

Further, a nozzle arrangement in a plurality of, preferably all, chamber areas, which is arranged at the material web on one side or on both sides along its path of motion, is advantageous. The nozzle arrangement is advantageous, above all, for the circulating flow. A variable configuration of the nozzle arrangement makes possible a flow-related adaptation to the particular treatment needs in the various chamber areas. The nozzle arrangement may be configured such that lint and fibers cannot accumulate in it to a greater extent. The material web itself may act as a filter in this case. The lint is discharged again via the material web. The remaining lint collects at the bottom of the treatment chamber. However, this lint does not affect the performance of the treatment device, especially drying device, and may be removed, especially suctioned out, during the usual cleaning cycles.

The nozzle slots and especially their width may be varied in the nozzle arrangement. Progressive nozzle slots make possible an optimal setting of the flow and pressure conditions to the individual treatment process steps, especially drying process steps. This pertains, e.g., to the intensive inflow and heating up of the material web and the moisture possibly contained in it, an evaporation of the surface water and possibly of the core water. If necessary, a fluffiness and a volume of the material web may also be generated and set.

The claimed treatment technique, especially drying technique, is especially suitable for wet material webs of textile fibrous materials, especially nonwoven fibrous webs. The drying device may be used for drying a fibrous web, which comes from a hydroentanglement device arranged upstream. Here, the heat and the moisture or the water of the exhaust gas, especially of the exhaust air, can be regenerated and possibly be recycled in a circuit. The water contained in the moist exhaust air of the drying device can be separated from the gas flow and be fed to the hydroentanglement device. In this case, a regeneration, e.g., a purification and possibly a regulation of the temperature, can also take place. Consequently, the consumption of water during the hydroentanglement and drying of the nonwoven fibrous web can be reduced. In addition, the energy consumption can be reduced.

The treatment device, especially drying device, may be a component of a fiber treatment plant. After leaving the drying device, the dried material web may be subjected to a further treatment, e.g., a cutting or winding process.

The present invention is shown schematically and as examples in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
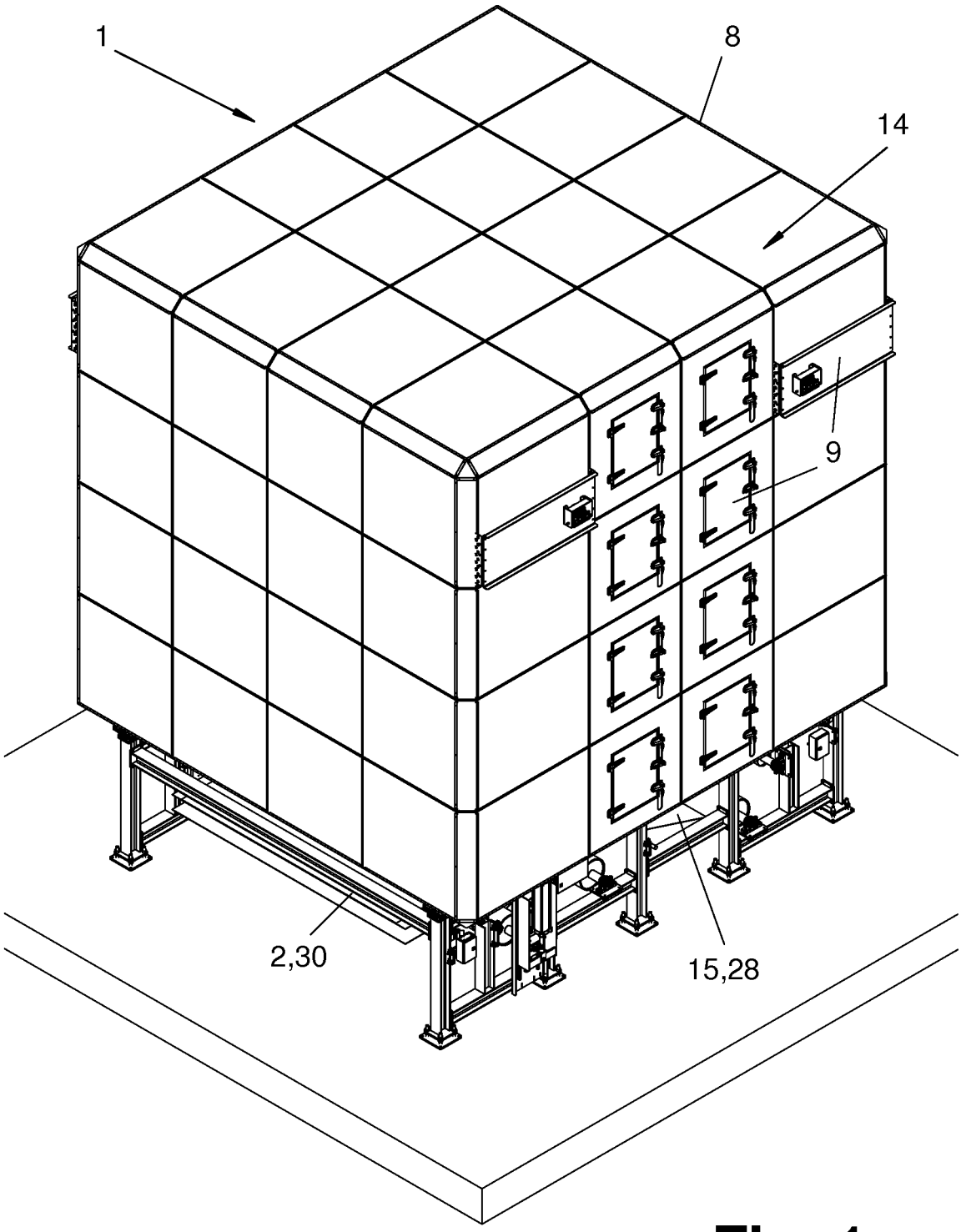
FIG. 1 is a perspective view showing a treatment device.

Referring to the drawings, the present invention pertains to a treatment device (1) and a method for treating a running material web (2). It is preferably a drying device (1) and a drying method for drying a wet material web (2). In addition, the present invention pertains to a fiber treatment plant (3) with such a treatment device (1) and to a corresponding plant-wide process.

A drying device (1) and a drying method are described below. The features apply correspondingly also to a different type of the treatment device (1) and of the treatment method.

The material web (2) may be dry or wet. It may consist of any desired materials. In the exemplary embodiments shown and preferred, the, e.g., wet material web (2) consists of a textile fibrous material, especially a nonwoven fibrous web. The wet material web (2) is moved forward within the drying device (1) and is thereby dried with a gas flow (16), and especially an air flow. As an alternative, a different gas may be used instead of air. The material web (2) has a strip-shaped configuration, its width being markedly greater than the thickness.

Figure 2:
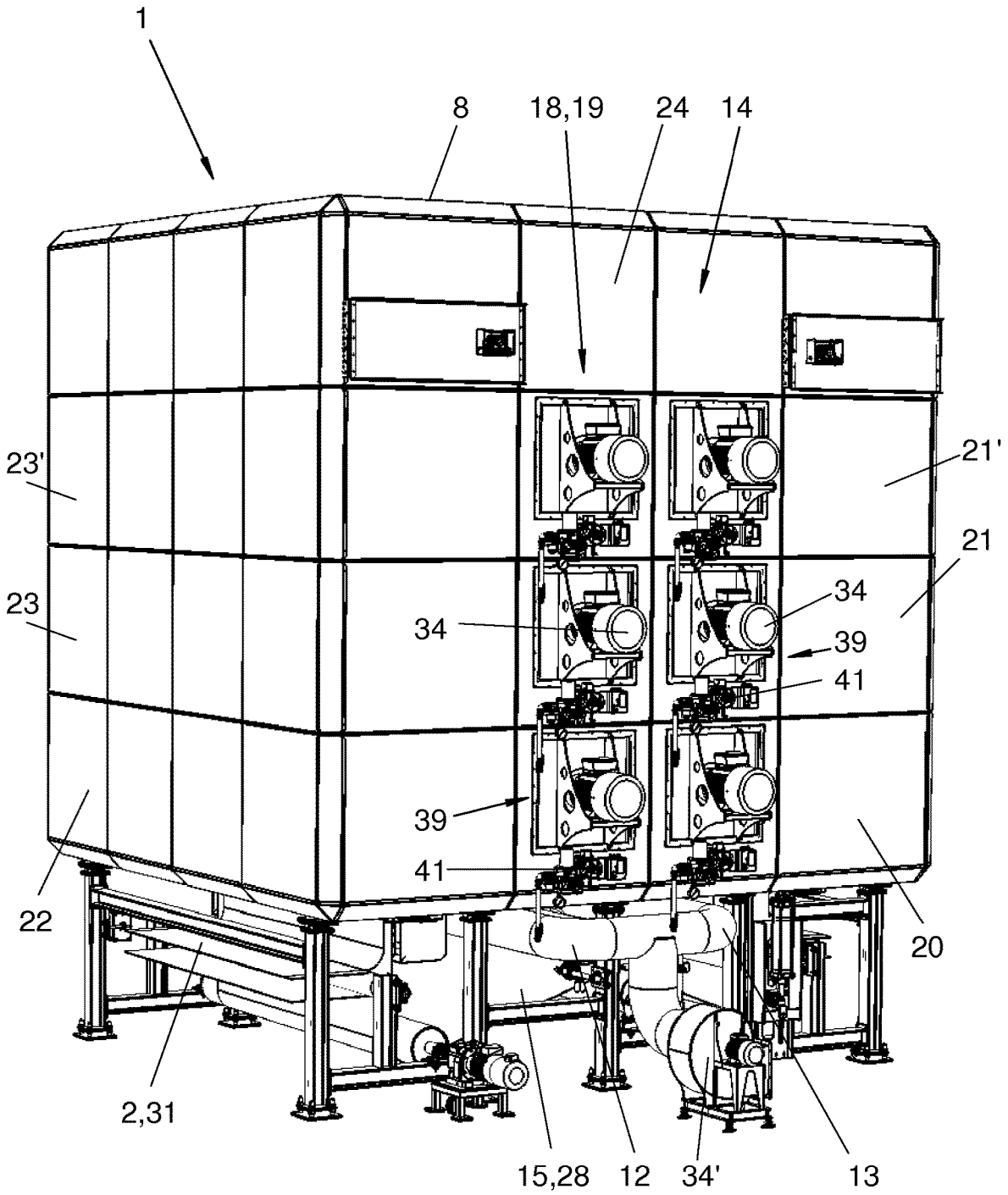
FIG. 2 is another perspective view showing a treatment device.
Figure 3:
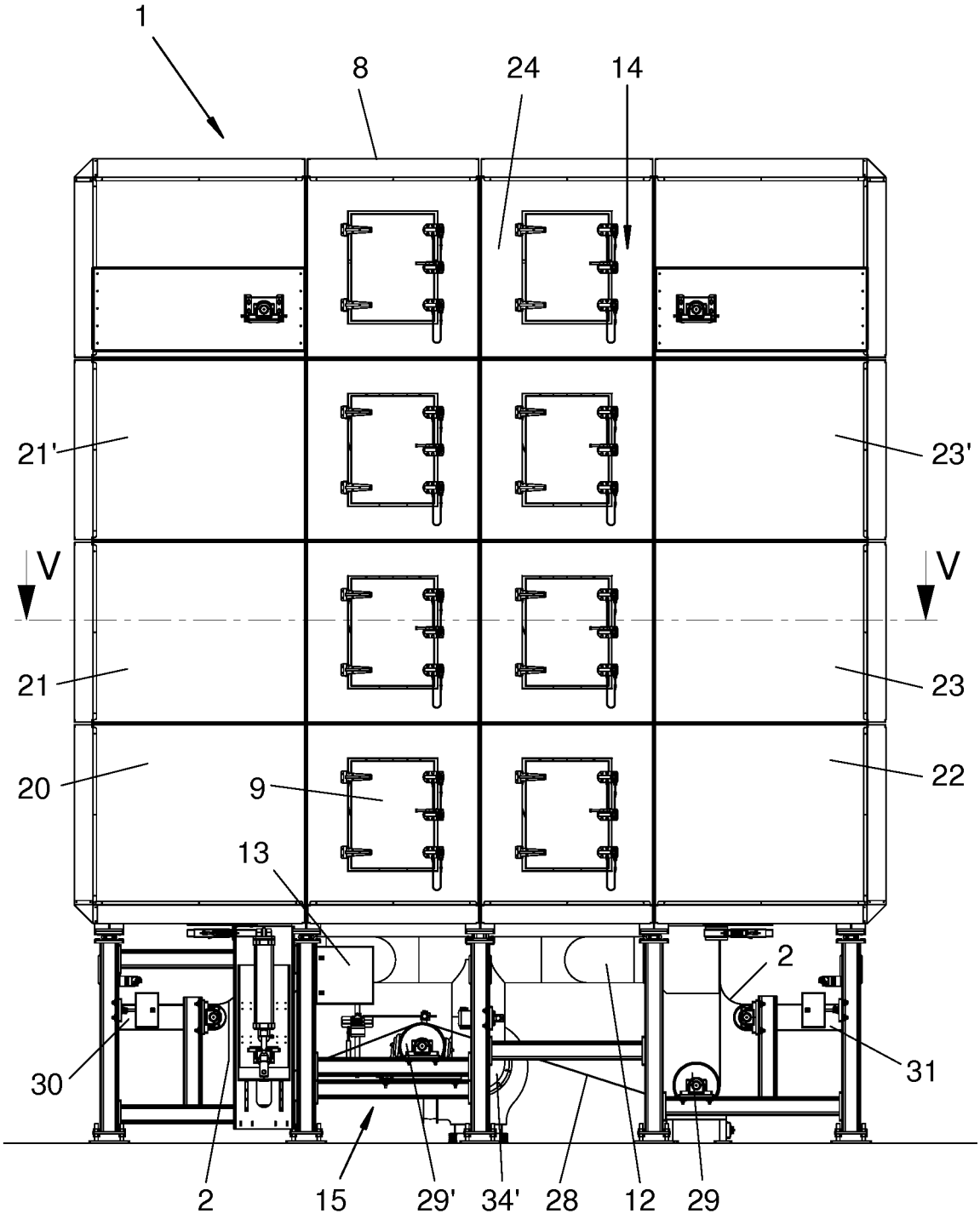
FIG. 3 is a front view of the treatment device.
Figure 4:
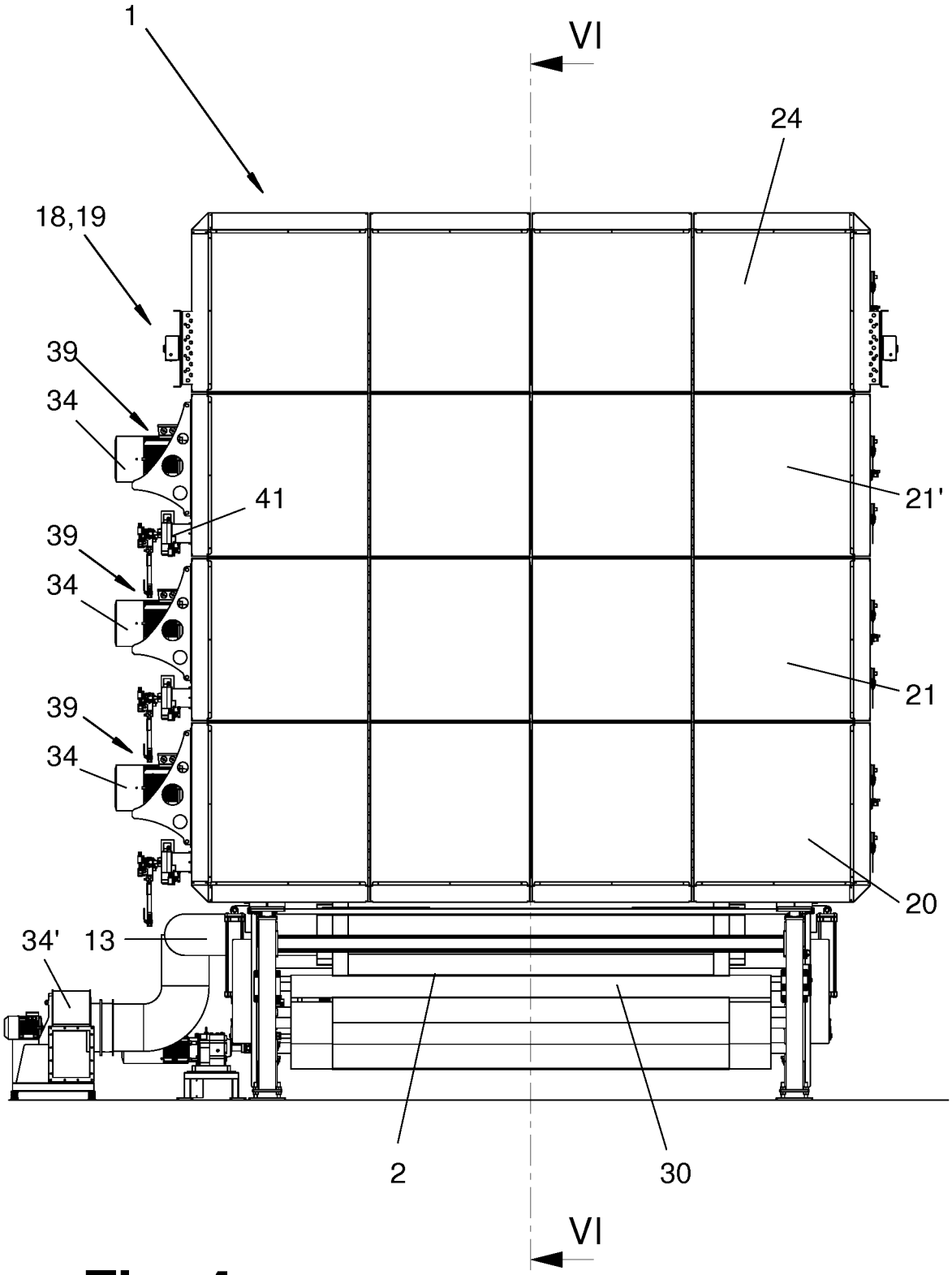
FIG. 4 is a lateral view of the treatment device.

The drying device (1) is shown in FIGS. 1 and 2 in an external view and perspective view with a view from the front and from behind. FIG. 3 shows a front view and FIG. 4 shows a tilted, lateral view of the drying device (1) of FIGS. 1 and 2. The drying device (1) has a housing (8) with a treatment chamber, especially drying chamber (14), lying inside, with an inlet (10) as well as with an outlet (11) for the material web (2) moved in the run direction (17).

The housing (8) has a preferably cuboid, especially cubic, shape. The area of the housing (8) may correspond to the area of common drum driers. The drying device (1), instead of a drum drier and possibly by way of replacement, may be installed in an existing plant (3), especially fiber treatment plant. The housing (8) is arranged on posts at a distance above the ground. The housing (8) has one or more accesses (9), e.g., doors or flaps, on one or more side walls, for the drying chamber (14) lying inside and the chamber areas (20-24) thereof, which will be explained below.

Figure 6:
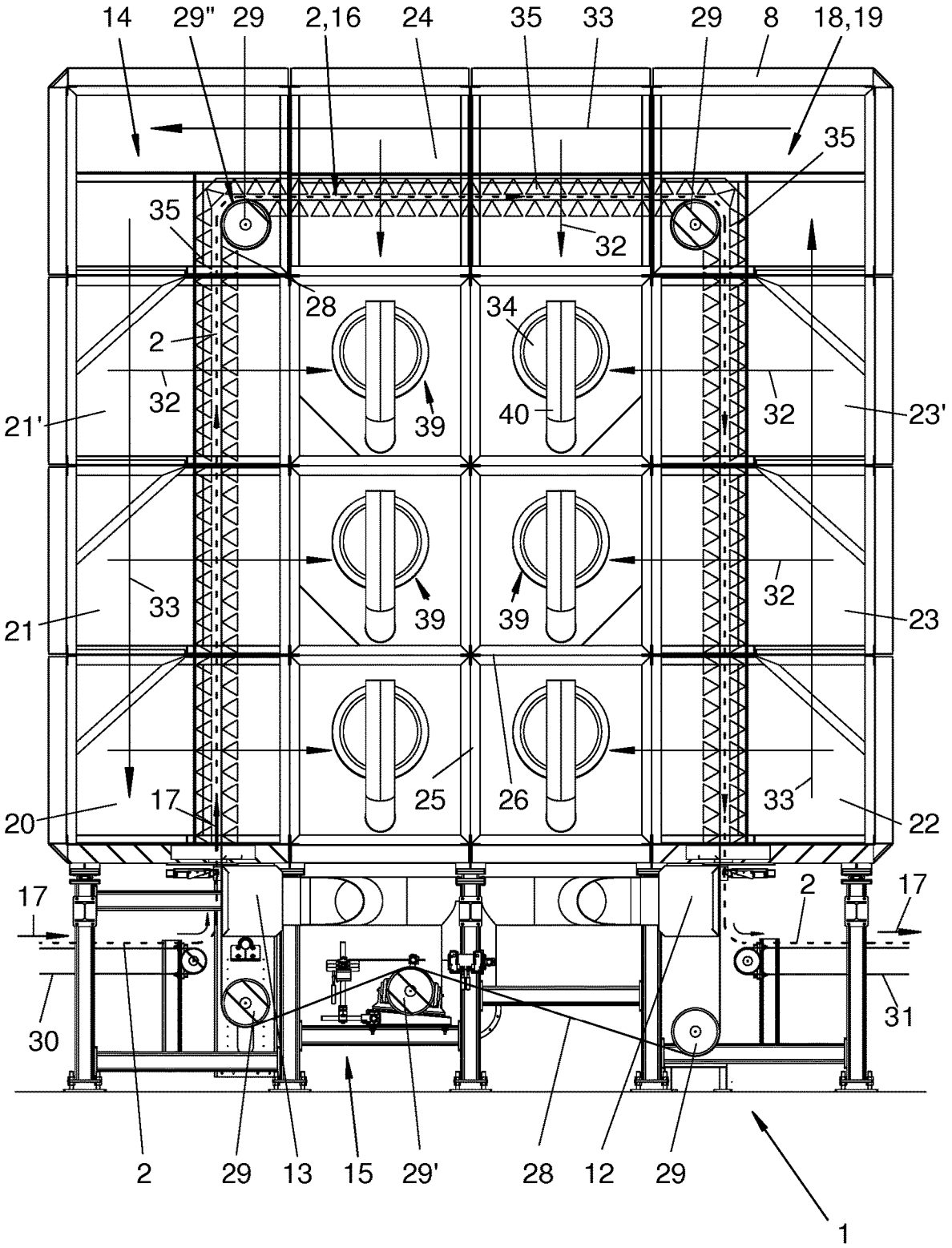
FIG. 6 is an upright longitudinal sectional view through the treatment device according to section line VI-VI from FIG. 4.
Figure 7:
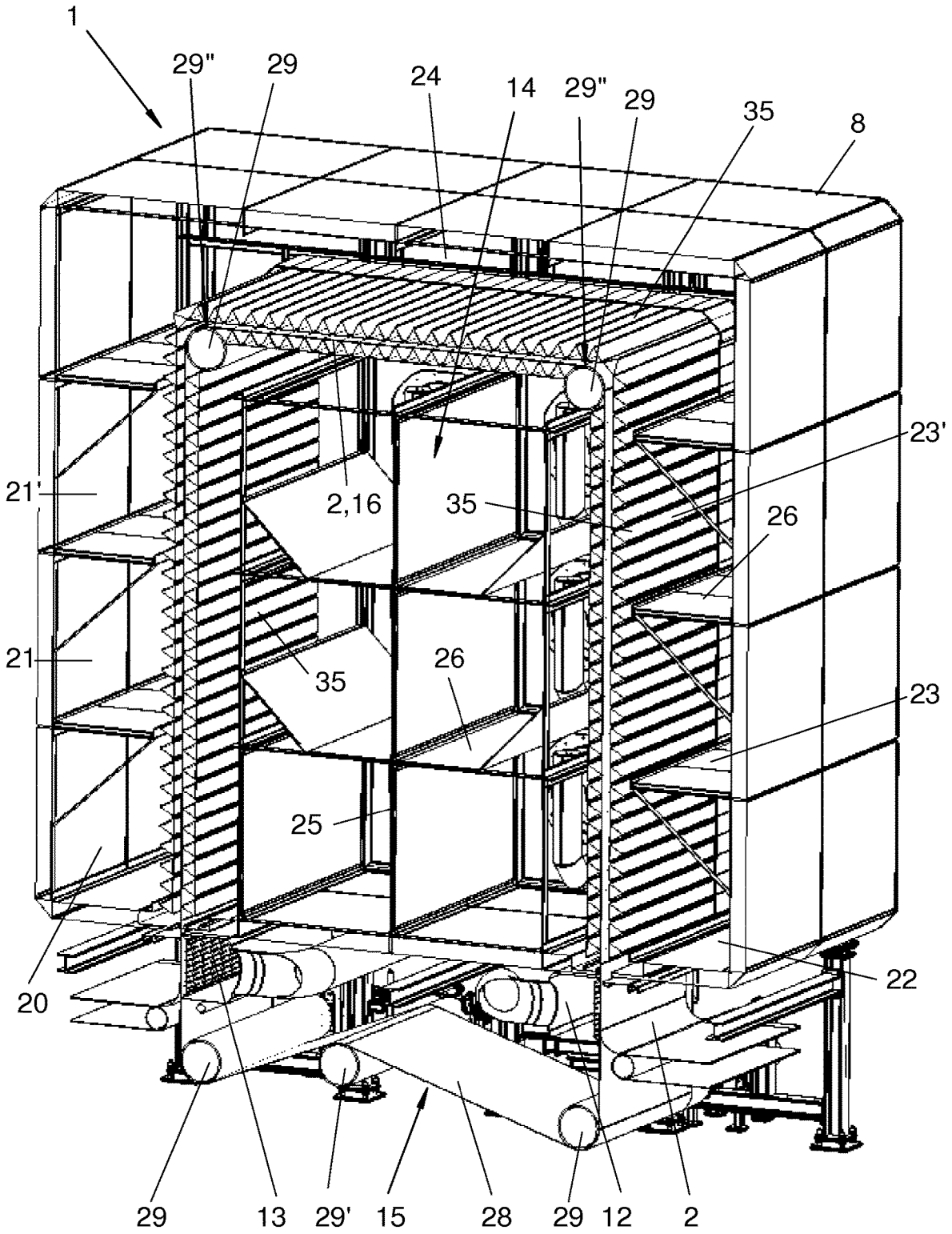
FIG. 7 is a front, cutaway, perspective view of the treatment device.

As FIGS. 6 and 7 especially illustrate, the treatment chamber (14) has a plurality of stationary chamber areas (20-24) arranged above one another and next to one another, through which the material web (2) passes. The running material web (2) is thereby guided in the treatment chamber (14) in a path of motion (16) directed upwards and downwards. The path of motion (16) is preferably configured as an upright loop, which has two upright, especially vertical, path sections and an upper, especially horizontal, path section. The inlet (10) and the outlet (11) for the material web (2) are arranged at the lower area of the treatment device (1), especially of the drying chamber (14). They are preferably located at the bottom of the drying chamber (14). The material web (2) enters and exits here with an upright, especially vertical direction of extension and motion. The inlet (10) and the outlet (11) are configured, e.g., as slot-like openings in the chamber bottom.

The material web (2) is fed to the inlet (10) via a conveying device (30). At the outlet (11), it is taken over and transported away by another conveying device (31). The conveying devices (30, 31) are configured, e.g., as circulating, horizontal conveyor belts, wherein they may, as an alternative, have any desired, other shape and configuration.

Within the drying chamber (14), the material web (2) is guided along the loop-like path of motion (16) by means of a guiding device (15). The guiding device may have different configurations. In the exemplary embodiment shown, it is formed by a circulating, flexurally elastic conveying device (28), e.g., by an endless conveyor belt, which is set into circular motion by means of a suitable drive (29'). The conveying device (28) has a gas-permeable configuration and has, e.g., a grid structure or fabric structure with openings for the passage of gas.

The conveying device (28) picks up the material web (2) at the inlet (10) on one side, especially on the outside, carries it along and transports it along the path of motion (16) up to the outlet (11). The material web (2) is thereby held and carried along due to blowing pressure of a gas flow in frictional contact with the conveying device (28). The gas flow impacting on one side can hold and fix the material web (2) in permanent contact with the conveying device (28), especially at the upright sections of the loop-like path of motion (16). The conveying device (28) is preferably driven at a circulating speed, which corresponds to the feed and discharge speed of the material web (2).

The guiding device (15) further has a plurality of deflecting devices (29), e.g., rotating and possibly driven deflection rollers, for the conveying device (28) and the material web (2) in contact with the conveying device (28). Two deflecting devices (29) are arranged at a distance next to each other in the upper area of the drying chamber (14). They define the deflection points of the path of motion (16) and are preferably located at the same height as well as vertically above the inlet (10) and the outlet (11). One or more of the deflecting devices (29) in the upper area of the drying chamber (14) may have a holding device (29") for the material web (2) and possibly the conveying device (28). The holding device (29") may be configured, e.g., as a suction device.

The conveying device (28) is guided downwards out of the drying chamber (14) and the housing (8) and via additional lower deflecting devices (29) as well as a drive (29') in addition to a clamping device. A sensor mechanism is also arranged here for belt and motion detection. The conveying device (28) is guided via the deflecting devices (29) in an essentially rectangular and closed circular path.

Figure 5:
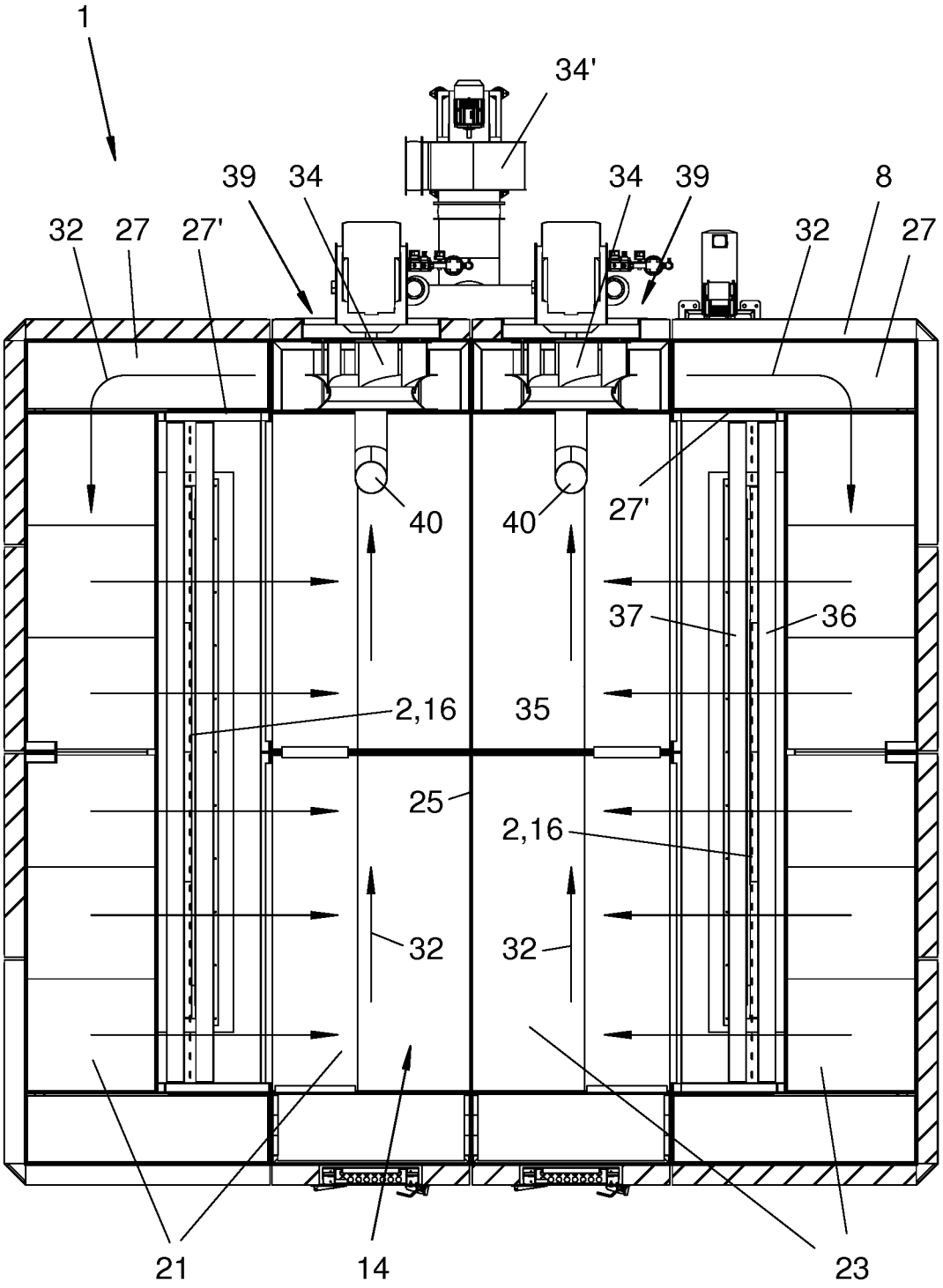
FIG. 5 is a horizontal cross sectional view through the treatment device according to section line V-V from FIG. 3.

According to FIGS. 5 through 7, at least some of the chamber areas (20-24), which are arranged above one another and next to one another, are arranged in a chamber matrix in the drying chamber (14). In the preferred embodiment shown, the chamber matrix has two columns of chamber areas (20-23') arranged next to one another and two or more rows, e.g., three rows, of chamber areas (20-23') arranged above one another. The chamber matrix preferably has a uniform configuration, the adjacent chamber areas (20-23') each being arranged and oriented flush next to one another and above one another. FIG. 6 illustrates this centrally symmetrical arrangement. On the top side, the drying chamber (14) has a central chamber area (24), which extends over both columns of the chamber areas (20, 21, 21' and 22, 23, 23') and connects these in the transverse direction. The central chamber area (24) is especially arranged in a horizontal position. As FIG. 5 illustrates, the chamber areas (20-24) extend over the depth of the drying chamber (14).

In the embodiment shown, seven chamber areas (20-24) are present. According to FIG. 6, three chamber areas (20, 21, 21') are arranged above one another in the left column. In the right column, three chamber areas (22, 23, 23') are arranged above one another in the vertical position. In said three rows, the chamber areas (20, 22) and (21, 23) as well as (21', 23') are each arranged next to one another and centrally symmetrically in the horizontal position. The chamber areas (20-23') preferably have each the same size.

The material web (2) passes through the chamber areas (20-24) one after the other. An upright motion section of the path of motion (16) passes through each of the chamber areas (20, 21, 21') and (22, 23, 23') arranged above one another in the two columns. The deflecting devices (29) are also located in the upper chamber area (24). In the embodiment being shown, the loop-shaped path of motion (16) has a downwards open U-shape. The chamber areas (20-24) have a cuboid shape and are configured as cavities. The material web (2) or its path of motion (16) passes approximately centrally through the chamber areas (20-24). The material web (2) or the path of motion (16) divides the chamber areas (20-23') each into an outer peripheral partial area and an inner or central partial area.

The chamber areas (20-24) are separated from one another by partitions or walls (25, 26). The partitions (25, 26) may have different configurations. An upright and preferably central partition (25) is arranged between the columns of the chamber matrix and each of the chamber areas (20-23') arranged above one another. The partition has an essentially gas-tight configuration and separates the chamber areas (20, 22), (21, 23) and (21', 23') on the side or on the left and on the right from one another in terms of flow.

Partitions (26) are arranged in a horizontal position between each of the rows of the chamber areas (20-24) arranged horizontally above one another in the chamber matrix. The partitions or bottoms (26) may have, on the one hand, a passage opening for the path of motion (16) or the material web (2). They may further have another bottom opening, which makes possible an upright passage of gas in some places. In particular, the treatment gas may flow from the bottom upwards because of the thermal parameters.

The treatment device (1) has an aerating device (18) for generating a gas flow in the drying chamber (14). The treatment device (1) may further have a heating device (19) for heating the treatment gas.

The aerating device (18) is configured such that it generates a circulating flow (32) of the gas in each of the chamber areas (20-24). The circulating flow (32) is directed against and through the material web (2) on one side and may pass through this material web. The direction of flow may be directed transversely or obliquely to the path of motion (16). According to FIGS. 5 and 6, the circulating flow (32) is oriented in an especially horizontal position in the chamber areas (20-23') arranged in the chamber matrix. In the horizontal chamber area (24), the circulating flow has an upright, especially vertical, orientation.

The aerating device (18) is further configured such that it generates a counterflow (33) of the treatment gas directed against the run direction (17) of the material web (2) between the chamber areas (20-24). The counterflow (33) is directed from the outlet (11) to the inlet (10). It extends along the path of motion (16) in the drying chamber (14). The counterflow (33) has a moisture content increasing over the flow path.

The entering material web (2) has the maximum moisture content at the inlet (10). Here, due to the counterflow (33), the treatment gas likewise has a high degree of saturation with moisture, especially water. In the run direction (17) of the material web (2), the gas flows, especially circulating flows (32) and the counterflow (33) as well as the material web (2) become increasingly drier. The material web (2) and the gas flows (32, 33) have the lowest degree of moisture at the outlet (11).

The aerating device (18) has a feed (12) for fresh gas and a discharge (13) for exhaust gas with a blower (34') each. The fresh gas is fed into the drying chamber (14) with excess pressure and the exhaust gas is suctioned out of the drying chamber (14) with negative pressure.

During a drying process, the fresh gas has the lowest moisture content and the exhaust gas has the highest moisture content. The feed (12) may be arranged at any desired, suitable place of the drying chamber (14). It is located, e.g., on the chamber bottom side and leads to the chamber area (22) on the right arranged directly above the outlet (11).

The discharge (13) is likewise arranged in the lower area of the drying chamber (14), preferably at the chamber bottom. It leads, e.g., to the chamber area (20) on the left arranged directly above the inlet (10). The chamber areas (20, 22) are the lower chamber areas in the chamber matrix.

Due to the separation in space and the distance as well as the pressure differences of the feed (12) and the discharge (13), the counterflow (33) is generated in the drying chamber (14). The counterflow (33) flows along the path of motion (16) and through the chamber areas (20-24) following one another. The central partition (25) and the gas-tight partition (26) on the bottom of the upper chamber area (24) are advantageous for this and force the counterflow (13) into the desired path.

The aerating device (18) has a plurality of blowers (34), which are each associated with a chamber area (20-23'). A blower (34) may selectively be present or absent in the upper chamber area (24). The blowers (34) are preferably arranged on the rear side of the housing (8) and on the rear wall there. They are preferably configured as circulating air blowers, which circulate the treatment gas located in the respective chamber area (20-24) and generate said horizontal circulating flow (32). They take in, e.g., axially and blow out radially. The holding device (29"), especially suction device, at the upper deflecting device or at the upper deflecting devices (29) may be connected to the suction side of the upper blower.

As FIG. 5 illustrates in the cutaway top view, the material web (2) reaches only above a part of the chamber area depth, wherein an overflow duct (27) with a partition (27) remains between the rear wall of the housing (8) and the adjacent edge of the material web (2) or the path of motion (16). The blowers (34) leading to the partition (27') take in the treatment gas located in the central partial area between the partition (25) and the material web (2) in the rearward direction and blow it laterally through the overflow duct (27) into the peripheral partial area. From here, the treatment gas passes through the material web (2) again into the central partial area. The material web (2) extends between the rear-side partition (27') and the gas-tight front wall of the respective chamber area (20-24). The chamber front wall may be spaced apart from the front wall of the housing (8) according to FIG. 5.

The heating device (19) has a plurality of heating modules (39), which are each associated with a chamber area (20-24). A heating module (39) may selectively be present or absent in the upper chamber area (24). The heating modules (39) may have an identical configuration and be operated with any desired, suitable heating units. In the exemplary embodiment shown, the heating modules (39) burn a heating gas or a liquid heating medium and have for this each a heater (40), e.g., a burner, located in the respective chamber area (20-24), and an external port (41), e.g., a gas port. The heaters (40) are preferably located in front of the respective blowers (34).

The blowers (34) and/or the heating modules (39) are each arranged centrally and close to the central partition (25). The negative-pressure zones and/or heating zones of the chamber areas (20-24) formed hereby are each located within the loop-shaped path of motion (16) or material web (2). The excess pressure zones are each arranged outside of said path of motion (16) or material web (2).

The chamber areas (20-24), through which the material web (2) runs in the run direction (17), may have different climatic conditions and/or flow conditions of the respective gas flow (32, 33). The respective heating modules (39) and blowers (34) may be actuated and set by means of a control unit, not shown. In particular, the chamber areas (20-24) may have different temperatures and possibly different moisture contents of the treatment gas. For thermal reasons, the hot treatment gas rises upwards, anyway, into the chamber areas lying above one another. In the lower chamber areas (20, 22) at the inlet (10) and the outlet (11), the gas flow is regulated at a lower temperature than in the chamber area (21, 21', 23, 23', 24) arranged above them.

Figure 8:
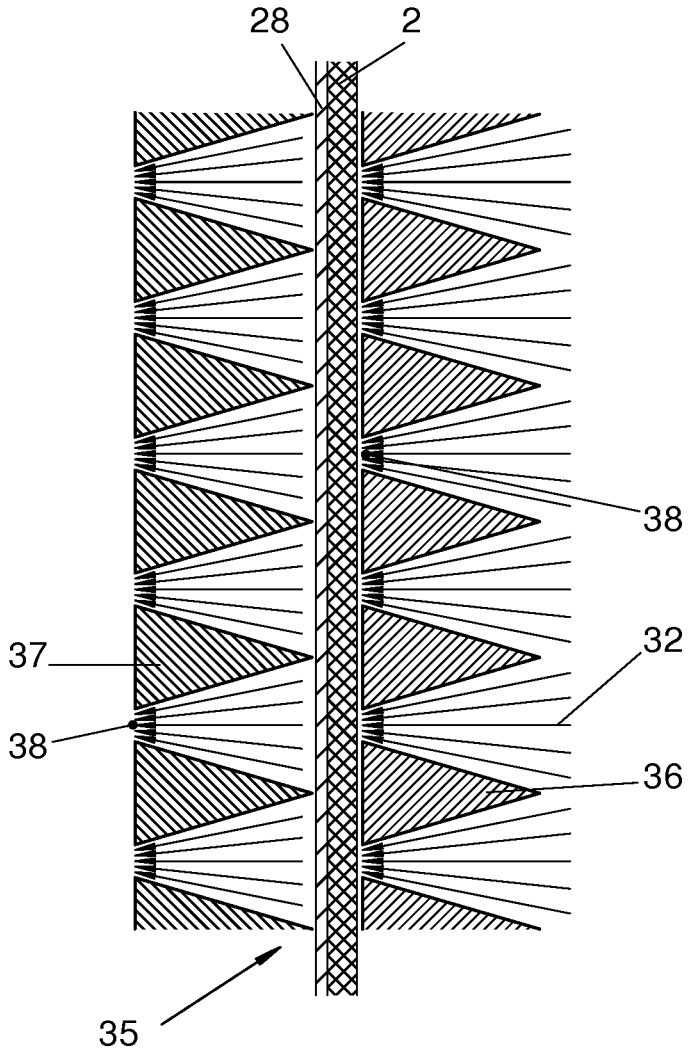
FIG. 8 is a sectional view of a nozzle arrangement.

According to FIGS. 6 through 8, the aerating device (18) has a nozzle arrangement (35) for the gas flow, especially the circulating flow (32), in a plurality of chamber areas (20-24) at the material web (2). The nozzle arrangement (35) may have a variable configuration. It consists, e.g., of a plurality of strip-like nozzle bodies (36, 37), which have an essentially triangular configuration and which are arranged next to one another or above one another at spaced locations and form a nozzle opening (38) between each of them. The nozzle arrangement (35) has a row of a plurality of outer nozzle bodies (36) in the flow direction in front of the material web (2) and a row of a plurality of inner nozzle bodies (37) in the flow direction behind the material web (2), e.g., in each of the chamber areas (20-24). FIG. 8 illustrates this arrangement. Due to the triangular shape of the nozzle bodies (36, 37), the nozzle areas or flow areas formed between them are convergent and bundle each the incoming gas flow towards the narrow, slot-like nozzle opening (38).

According to FIGS. 6 and 7 the nozzle bodies (36, 37) extend transversely to the run direction (17) of the material web (2) and in the depth direction of the drying chamber (14). The nozzle bodies (36, 37) are each held at their ends in a framework or frame. This arrangement may be movable or adjustable. Consequently, the width of the nozzle openings (38) in the run direction (17) as well as possibly the number of nozzle bodies (36, 37) lined up in a chamber area may be varied. The nozzle arrangement (35) extends in at least some areas, preferably in a circular manner, along the path of motion (16) and through passage openings into the horizontal partitions (26) of the chamber areas (20-23') located in the chamber matrix as well as through the upright partitions of the upper chamber area (24).

The treatment device (1), especially drying device, may be a single device. As an alternative, it may be connected to a plurality of devices arranged upstream and/or downstream. In particular, the drying device (1) may form a functional and possibly also structural unit with a hydroentanglement device (6) arranged upstream. Further, as an alternative or in addition to the drying device (1), a further treatment (7), e.g., a cutting device, a winding device or another supply device or the like for the material web (2) may be arranged downstream.

The combined devices (1 and 6) or (1 and 7) or (1, 6 and 7) may form independent components and functional units. These may also be integrated into a primary plant (3), e.g., a fiber treatment plant.

Figure 9:
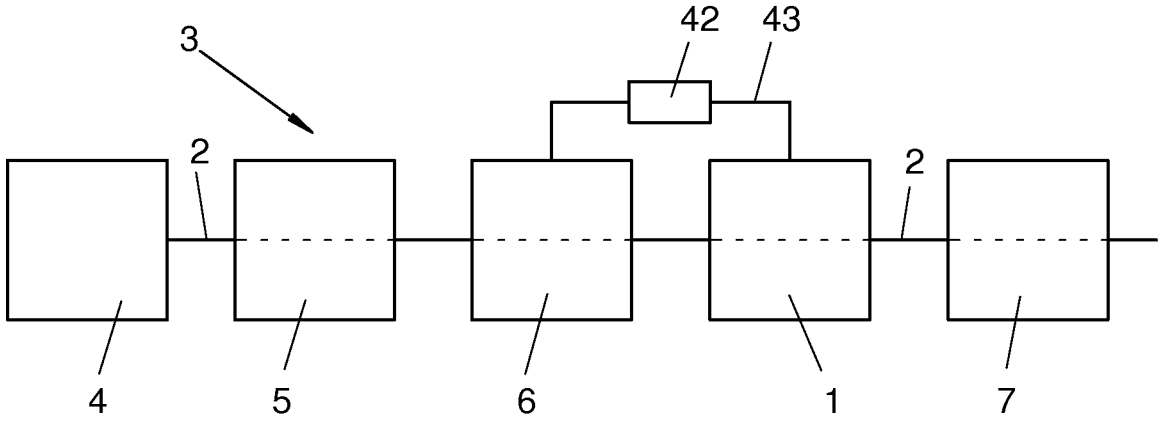
FIG. 9 is a schematic view of a fiber treatment plant with a treatment device and other plant components.

FIG. 9 shows such a fiber treatment plant (3) with a web-forming device (4) which forms a single-web or multiweb nonwoven fibrous web (2), which forms the material web or at least a preliminary stage for the material web (2). The web-forming device (4) may be configured in different ways, e.g., as a card or carder, as an airlay machine or the like. In addition, a fiber treatment is associated with the web-forming device (4).

The web-forming device (4) discharges the material web or webs (2) to a laying device (5) arranged downstream, which lays the fibrous web to form a multilayered nonwoven. It is configured, e.g., as a nonwoven-laying apparatus, especially as a crosslapper and then feeds the multilayered nonwoven to the hydroentanglement device (6). The hydroentangled nonwoven forms the wet material web (2), which is then fed to the drying device (1). The dried material web (2) is then transferred to a further treatment (7). The laying device (5) may possibly be omitted, the material web (2) or the fibrous web being fed directly from the web-forming device (4) to the hydroentanglement device (6).

According to FIG. 9, the drying device (1) may be connected to the hydroentanglement device (6) arranged upstream via a circuit (43) for the moisture in the exhaust air. The water contained in the exhaust air may be separated from the drying air by means of a regenerating device (42) and be fed as industrial water to the hydroentanglement device (6). Furthermore, the moisture or the separated water may be treated, e.g., filtered and/or heated, before it is fed into the hydroentanglement device (6).

A variety of variations of the embodiments shown and described are possible. In particular, the features of the embodiments described above and of the variants mentioned may be combined with one another in any desired manner, and may also possibly be exchanged with one another.

The path of motion (16) may form a plurality of loops and thereby meander. The number of columns of chamber areas (20-23') arranged above one another may be greater than two or three. The structural shape of the components of the treatment device (1), especially drying device, may vary. This may pertain to the guiding device (15), the aerating device (18), the heating device (19), the chamber division and the formation of the partitions (25, 26).

The material web (2) may also be treated with a gas flow for other purposes in the treatment device (1). This may be used, e.g., for a chemical reaction of the web material or for the purpose of evaporating or expelling ingredients, e.g., solvents, etc., from the material web (2). The gas flow may also be used for cooling purposes, wherein a cooling device is used instead of the heating device (19). Further, additives may be added to the gas flow by a conditioning device and be fed in a distributed manner to the material web (2). The drying chamber (14), one or more of which may be present, is generally a treatment chamber and may be configured differently in adaptation to a different treatment process.

While specific embodiments of the invention have been shown and described in detail to illustrate the application of the principles of the invention, it will be understood that the invention may be embodied otherwise without departing from such principles.

The invention claimed is:

1. A fluidic treatment device for a material web configured as a nonwoven fibrous web, the treatment device comprising:

an aerating device for generating a gas flow;

a nonwoven fibrous material web drying treatment chamber, in which the material web is moving as a running material web and is treated with the gas flow comprising air;

a nonwoven fibrous material web inlet for the material web;

a nonwoven fibrous material web outlet for the material web, wherein the treatment chamber has a plurality of chamber areas, comprising chamber areas which are arranged above one another and chamber areas arranged horizontally next to one another stationarily, the material web passing through the chamber areas approximately in a center of the chamber areas, wherein each of the chamber areas is configured to direct the gas flow to flow against one side of the material web and through the material web; and a guiding device for guiding a path of motion of the material web, the guiding device comprising a gas-permeable, flexurally elastic conveying device comprising a belt for conveying the material web circulating in the treatment chamber, wherein the nonwoven fibrous material web inlet and the nonwoven fibrous material web outlet are arranged and formed at a lower area of the treatment device for an entry and exit of the material web with an upright extension of the material web.

2. A fluidic treatment device in accordance with claim 1, wherein the running material web is guided in an upwards and downwards directed path of motion in the treatment chamber, wherein the path of motion is configured as a single upright loop.

3. A fluidic treatment device in accordance with claim 1 wherein the treatment chamber has a central, connecting chamber area on a top side with a horizontal orientation.

4. A fluidic treatment device in accordance with claim 1 wherein:

the aerating device generates a circulating flow of the gas in each of the chamber areas; and the circulating flow is directed through the material web.

5. A fluidic treatment device in accordance with claim 4, further comprising a heating device for heating the gas flow in each of the chamber areas.

6. A fluidic treatment device in accordance with claim 4, wherein:

the circulating flow is oriented horizontally in the chamber areas, which are arranged in a matrix; and the circulating flow is oriented vertically in an upper, horizontal chamber area.

7. A fluidic treatment device in accordance with claim 4, wherein:

the aerating device generates a counterflow of the gas directed against a run direction of the material web between the chamber areas; and the counterflow is directed from the nonwoven fibrous material web outlet to the nonwoven fibrous material web inlet and has an increasing moisture content over a counterflow path.

8. A fluidic treatment device in accordance with claim 5, wherein the aerating device has a plurality of blowers and the heating device has a plurality of heating modules, which are each associated with a chamber area.

9. A fluidic treatment device in accordance with claim 4, wherein the aerating device has a nozzle arrangement for the gas flow, and for the circulating flow, at the material web in each of a plurality of chamber areas.

10. A fluidic treatment device in accordance with claim 9, wherein the nozzle arrangement has a variable configuration.

11. A fluidic treatment device in accordance with claim 1 wherein:

the guiding device further comprising deflecting devices for the conveying device; and at least one of the deflecting devices has a holding device comprising a suction device for suction holding of the material web.

12. A fluidic treatment device in accordance with claim 1 wherein:

the conveying device circulating in a closed path is guided and deflected as well as driven downwards out of the treatment chamber; and the nonwoven fibrous material web inlet and the nonwoven fibrous material web outlet are arranged at a bottom of the treatment chamber.

13. A fluidic treatment device in accordance with claim 12, wherein the gas flow in lower chamber areas is regulated at a lower temperature at the nonwoven fibrous material web inlet and the nonwoven fibrous material web outlet than in chamber areas arranged above the nonwoven fibrous material web inlet and the nonwoven fibrous material web outlet.

14. A fluidic treatment device in accordance with claim 7, wherein a feed and a discharge are arranged in various chamber areas at a lower area of the treatment chamber and generate the counterflow by means of a pressure drop.

15. A fluidic treatment device in accordance with claim 1 further comprising a regenerating device for exhaust gas.

16. A fluidic treatment device in accordance with claim 1 in combination with a hydroentanglement device arranged upstream of the treatment device.

17. A fluidic treatment device in accordance with claim 1 in combination with a further treatment device comprising one or more of a cutting device and a winding device, for treated material web, wherein the further treatment device is arranged downstream of the treatment device.

18. A fiber treatment plant comprising:

a web-forming device comprising a card, for a running material web configured as a nonwoven fibrous web;

a laying device for the fibrous web;

a hydroentanglement device; and a treatment device comprising:

an aerating device for generating a gas flow;

a nonwoven fibrous material web drying treatment chamber, in which the running material web is treated with the gas flow comprising air;

a nonwoven fibrous material web inlet for the material web;

a nonwoven fibrous material web outlet for the material web, wherein the treatment chamber has a plurality of chamber areas, comprising chamber areas which are arranged above one another and chamber areas arranged horizontally next to one another stationarily, the material web passing through the chamber areas approximately in a center of the chamber areas, wherein each of the chamber areas is configured to direct the gas flow to flow against one side of the material web and through the material web; and a guiding device for guiding a path of motion of the material web, the guiding device comprising a gas-permeable, flexurally elastic conveying device comprising a belt for conveying the material web circulating in the treatment chamber, wherein the nonwoven fibrous material web inlet and the nonwoven fibrous material web outlet are arranged and formed at the a lower area of the treatment device for an entry and exit of the material web with an upright extension of the material web.

19. A method for fluidic treatment of a material web configured as a nonwoven fibrous web, the method comprising:

providing a treatment device comprising an aerating device for generating a gas flow; a nonwoven fibrous material web drying treatment chamber, in which the material web is moving as a running material web and is treated with the gas flow comprising air; a nonwoven fibrous material web inlet for the material web; a nonwoven fibrous material web outlet for the material web, wherein the treatment chamber has a plurality of chamber areas, comprising chamber areas which are arranged above one another and chamber areas arranged horizontally next to one another stationarily, the material web passing through the chamber areas approximately in a center of the chamber areas, wherein each of the chamber areas is configured to direct the gas flow to flow against one side of the material web and through the material web; and a guiding device for guiding a path of motion of the material web, the guiding device comprising a gas-permeable, flexurally elastic conveying device comprising a belt for conveying the material web circulating in the treatment chamber;

with the provided treatment device, treating the fibrous web as a running material web with the gas flow comprising air, and with the material web entering through the nonwoven fibrous material web inlet and exiting through the nonwoven fibrous material web outlet of the treatment device, and the material web passing through the plurality of chamber areas and with the gas flowing against one side of the material web and through the material web and the belt to an opposite side of the material web, in each of the chamber areas and wherein a circulated gas flow passes through the material web into each of the chamber areas with the material web being held in contact with the conveying device and being carried along by the conveying device, wherein the material web enters and exits with upright extension of the material web through the nonwoven fibrous material web inlet and the ononwoven fibrous material web outlet, which nonwoven fibrous material web inlet and the nonwoven fibrous material web outlet are each located at a lower area of the treatment device.

20. A method in accordance with claim 19, wherein the running material web is guided in the treatment chamber in a path of motion, which is directed upwards and downwards and is configured as a single upright loop.

21. A method in accordance with claim 19, wherein the gas flow is independently set and conditioned in the chamber areas.

22. A fluidic treatment device in accordance with claim 7, wherein the plurality of chamber areas are separated from one another by partitions.

* * * * *